US008267251B2

(12) United States Patent
Mongan et al.

(10) Patent No.: US 8,267,251 B2
(45) Date of Patent: Sep. 18, 2012

(54) CASE FOR ENCLOSING A PERSONAL ELECTRONIC DEVICE AND A CARD

(75) Inventors: Ryan Hill Mongan, Orange, CA (US); Bryan Lee Hynecek, Redwood City, CA (US); David Chiawen Lean, San Francisco, CA (US); Jarret Weis, San Francisco, CA (US); Jon Dukerschein, San Francisco, CA (US)

(73) Assignee: Speculative Product Design, LLC, Palo Alto, CA (US)

( * ) Notice: Subject to any disclaimer, the term of this patent is extended or adjusted under 35 U.S.C. 154(b) by 0 days.

(21) Appl. No.: 13/238,803

(22) Filed: Sep. 21, 2011

(65) Prior Publication Data

US 2012/0067751 A1 Mar. 22, 2012

Related U.S. Application Data

(60) Provisional application No. 61/403,718, filed on Sep. 21, 2010.

(51) Int. Cl.
*A45C 11/18* (2006.01)

(52) U.S. Cl. ..... 206/576; 206/38; 206/39

(58) Field of Classification Search ..... 206/37, 206/39, 39.5, 38, 449, 454, 320, 576
See application file for complete search history.

(56) References Cited

U.S. PATENT DOCUMENTS

| | | | | |
|---|---|---|---|---|
| 4,768,648 | A * | 9/1988 | Glass | 206/38 |
| 6,026,873 | A * | 2/2000 | Van Geer | 150/147 |
| 6,164,442 | A * | 12/2000 | Stravitz | 206/233 |
| 6,341,693 | B2 * | 1/2002 | Konno et al. | 206/449 |
| 6,533,118 | B1 * | 3/2003 | Nelson | 206/449 |
| 8,047,364 | B2 * | 11/2011 | Longinotti-Buitoni | 206/320 |
| 2003/0230514 | A1 * | 12/2003 | Baker | 206/732 |
| 2007/0057004 | A1 | 3/2007 | Butler et al. | |
| 2008/0121321 | A1 * | 5/2008 | Tiner et al. | 150/131 |
| 2010/0224519 | A1 * | 9/2010 | Kao | 206/320 |

FOREIGN PATENT DOCUMENTS

| | | |
|---|---|---|
| KR | 200446444 Y1 | 10/2009 |
| KR | 100934120B110000 | 12/2009 |

OTHER PUBLICATIONS http://www.case-mate.com/iPhone-3G-Cases/Case-Mate-iPhone-3G--3GS-ID-Credit-Card-Cases.asp, downloaded from the internet on Apr. 23, 2012, 3 pages.

International Search Report and Written Opinion dated May 1, 2012 in related International Application No. PCT/US2011/052519 filed Sep. 21, 2011, 9 pages.

KR 100934120 published 29 2009, abstract only in English, downloaded from espacenet, 1 page.

KR 200446444 published Oct. 29, 2009, abstract only in English, machine generated by Google Translate, 1 page.

* cited by examiner

*Primary Examiner* — Jacob K Ackun
(74) *Attorney, Agent, or Firm* — SNR Denton US LLP

(57) ABSTRACT

Cases for enclosing a personal electronic device may also enclose one or more cards, such as credit cards, payment cards, coupons, receipts, identification cards, merchandise credit cards, gift cards, or business cards through the use of a retaining system. Exemplary cases may include a flexible inner layer and an exterior hard layer that may be permanently affixed to one another to form two fitted cavities, one for holding the personal electronic device and one for holding inserted cards.

8 Claims, 3 Drawing Sheets

CASE FOR ENCLOSING A PERSONAL ELECTRONIC DEVICE AND A CARD

RELATED APPLICATIONS

This application is a NONPROVISIONAL of, claims priority to, and incorporates by reference U.S. Provisional Patent Application 61/403,718 filed Sep. 21, 2010.

FIELD OF THE INVENTION

The present invention relates to a case for enclosing a personal electronic device and one or more cards, such as credit cards, payment cards, coupons, receipts, identification cards, merchandise credit cards, gift cards, or business cards.

BACKGROUND

Cases for phones, sometimes known as portfolio cases, that carry a personal electronic device and several credit cards are similar to a traditional wallet and typically have two sides, one that holds the cards and one that holds the personal electronic device, that are folded over one another. Known drawbacks for these types of cases include their expense, bulk, (adding to 5 mm or more to each side of the personal electronic device), and the styling is not to everyone's taste.

Other conventionally known cases for personal electronic devices include molded cases. These cases are typically manufactured via an injection molding process using polymers. Molded cases are typically very form fitting, manufactured at lower cost than the portfolio cases (because of the automation employed during the manufacturing), and available in a wide variety of styles. A molded case that includes a slot for inserting credit cards is known in the art but the design of this case has at least two drawbacks. First, it provides no protection between the back of an encased phone and the inserted cards. Hence, when cards are inserted into and removed from the case, the phone may become damaged or scratched. Second, there is no compliance or way to retain inserted cards provided by the case. Thus, inserted cards can inadvertently fall out of the case.

SUMMARY

Cases for enclosing a personal electronic device and one or more cards, such as credit cards, payment cards, coupons, receipts, identification cards, merchandise credit cards, gift cards, or business cards through the use of a retaining system are herein discussed. In some embodiments, the case may include multiple pieces, while in other embodiments the case may be one-piece.

An exemplary case may include a flexible inner layer and an exterior hard layer that may be permanently affixed to the flexible inner layer. The case may be sufficiently flexible to deform and thereby accept insertion of the personal electronic device and sufficiently rigid to reform around and securely retain the inserted personal electronic device. The flexible inner layer may be manufactured from, for example, rubber, silicon, plastic, and/or fabric.

The flexible inner layer may include a bottom surface and side surfaces joined to the bottom surface that extend upward therefrom in a manner similar to an open box. The bottom and side surfaces of the flexible inner layer may form a first fitted cavity and a top surface of an adjacent second fitted cavity. The first fitted cavity may be configured to accept and retain the inserted personal electronic device such that the bottom surface of the flexible inner layer covers a bottom surface of the inserted personal electronic device and the side surfaces cover at least a portion of side surfaces of the inserted personal electronic device. A second fitted cavity, which may be adjacent to the first fitted cavity, may be configured to accept and retain one or more inserted cards.

In some embodiments, the coefficient of static friction between the inserted card and the flexible inner layer is sufficient to hold the inserted card in place within the second fitted cavity. In other embodiments, the flexible inner layer may include a retaining feature that extends into the second fitted cavity so as to exert pressure on the inserted card and thereby retain the inserted card in the second fitted cavity.

In one embodiment, the case may include a first and second layer. The first layer may include a bottom surface and side surfaces joined to the bottom surface that extend upward therefrom and thereby form a first fitted cavity and a top surface of an adjacent second fitted cavity. The first fitted cavity may be configured to accept and retain an inserted personal electronic device such that the bottom surface of the first layer covers a bottom surface of the inserted personal electronic device and the side surfaces of the first layer cover at least a portion of side surfaces of the inserted personal electronic device. The second layer may include a bottom surface and side surfaces joined to the bottom surface that extend upward therefrom. The bottom and a first portion of the side surfaces of the second layer form the second fitted cavity and a second portion of the side surfaces of the exterior hard layer may substantially cover the side portions the first layer. The second fitted cavity may be configured to accept and retain at least one card and at least one of the first portion of the side surfaces may include an opening via which the card is inserted in the case.

In one embodiment, a coefficient of static friction between the inserted card and the first layer may be sufficient to hold the inserted card in place within the second fitted cavity. In another embodiment, the first layer may include a retaining feature that extends into the second fitted cavity so as to exert pressure on the inserted card and thereby retain the inserted card in the second fitted cavity.

Another exemplary case for enclosing a personal electronic device and one or more cards inserted therein may include an exterior hard layer and a flexible inner layer insert that is attached to the exterior hard layer. The case may be sufficiently flexible to deform and thereby accept insertion of the personal electronic device and sufficiently rigid to reform around and securely retain the inserted personal electronic device. The case may further include a first fitted cavity configured to accept and retain an inserted personal electronic device and a second fitted cavity configured to accept and retain the one or more inserted cards.

BRIEF DESCRIPTION OF THE DRAWINGS

The present application is illustrated by way of example, and not limitation, in the figures of the accompanying drawings, in which.

Figure 1A:
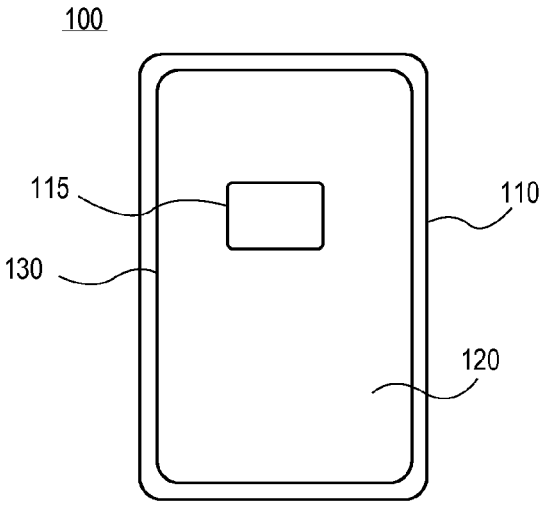
FIG. 1A is a top view of an exemplary case in accordance with embodiments of the present invention.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

As personal electronic devices become more and more integrated into people's lives, they are carried around wherever people go. Thus, it may be desirable to carry the personal electronic device around with a sub-set of the other items that a person also usually carries around. For example, if a personal electronic device could be carried along with, for example, an ID card, a business card, and/or a credit card, the user might be able to leave another bulky item such as a wallet at home. Thus, a case (otherwise known as a sleeve, holder, portfolio or shell) for a personal electronic device, such as a mobile phone, that can also retain one or more cards, such as credit or identification cards is herein described.

The cases described herein may be manufactured via, for example, a molding process and may therefore retain a relatively small size compared with an enclosed personal electronic device and design flexibility. The cases described herein are manufactured from at least two different materials. A first material may act as an exterior hard layer or bulk of a case and may be manufactured from, for example, a rigid or semi-rigid plastic metal, a polycarbonate material, and/or a para-aramid material. The first material may act to protect an enclosed personal electronic device from damage due to impact, puncture, shock, water, etc. A second material may act as a flexible inner layer and may have a retaining or compliance component that is either mechanical in nature (e.g. springs, cantilevers, beams, etc.) or is compliant by the very nature of the material (e.g. elastomerics) and may also act to protect an enclosed personal electronic device from damage due to impact, shock, water, etc.

The second material may further provide a barrier between a card inserted into the case and a personal electronic device the case is covering and may thereby protect an enclosed personal electronic device from scratching and other damage cased by inserting, removing, and/or retaining the cards in the case. The compliance, or flexibility, of the second material may also be utilized to add pressure or a static frictional force between itself and inserted card(s) and may thereby prevent an inadvertent loss of the cards that might otherwise occur when there is not sufficient frictional or other force to retain the inserted cards within the case.

FIG. 1A is a top view of a case 100 for enclosing a personal electronic device and a card including an exterior hard layer 110, a flexible inner layer 120, a retaining feature 115, and a first fitted cavity 130. Exemplary personal electronic devices include mobile telephones, so called "smart phones" (e.g., iPhone™ or Blackberry™), laptop computers, tablet computers, and the like. Exemplary cards include credit cards, payment cards, identification cards (e.g., driver's license, membership card, etc.), business cards, coupons, receipts, merchandise credit cards, gift cards, and the like.

Exterior hard layer 110 may be fabricated from, for example, metal, a rigid or semi-rigid plastic material, a rigid rubber material, a polycarbonate material, a para-aramid material and/or some combination thereof and may be any color or texture.

Flexible inner layer 120 may be made from any appropriately flexible material, such as rubber, silicon, or plastic and may include a mechanism for maintaining the attachment between the case and the portable electronic device. Exemplary attachment mechanisms include a clip, an extension, an adhesive material, and a magnetic material. Flexible inner layer 120 may be any color or pattern of colors. In some embodiments, flexible inner layer 120 may be manufactured from a material such that a coefficient of static friction between a card inserted into a second fitted cavity 160 (depicted in FIG. 1C) and flexible inner layer 120 may be sufficient to hold the inserted card in place within second fitted cavity 160.

Optionally, flexible inner layer 120 may include a retaining feature 115 that may operate to retain cards inserted into second cavity 160. In some embodiments, retaining feature 115 may extend into second cavity 160 and may be flexible enough to enable the insertion of a card into second cavity 160 and may exert pressure on the inserted card in a direction away from flexible inner layer 120 and toward the inside bottom surface of the second cavity 160.

First fitted cavity 130 may be shaped and configured to accept and retain an inserted personal electronic device such that the bottom surface of flexible inner layer 120 covers a bottom surface of the inserted personal electronic device and the side surfaces of flexible inner layer 120 cover at least a portion of side surfaces of the inserted personal electronic device.

Figure 1B:
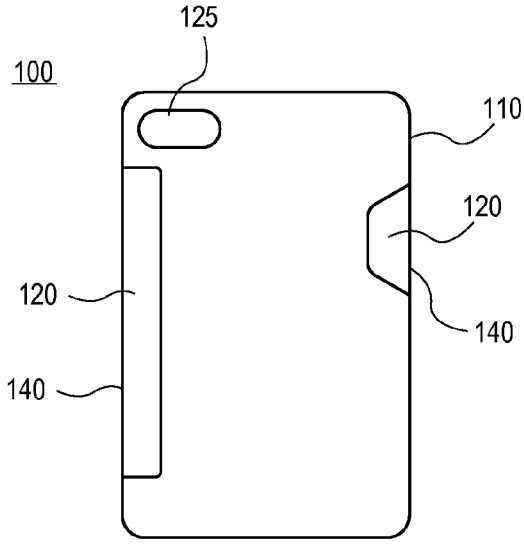
FIG. 1B is a bottom view of an exemplary case in accordance with embodiments of the present invention.

In some embodiments, case 100 may include one or more openings or cut away portions 140 into which a card may be inserted into second fitted cavity 160, as shown in FIG. 1B, which is a bottom view of case 100 showing an exterior surface of the bottom of exterior hard layer 110. Opening(s) 140 may be sufficiently large to enable the insertion of one or more cards into a second fitted cavity 160 and/or enable a user to access or remove an inserted card. When opening 140 is cut away from the bottom surface of exterior hard layer 110 as shown in FIG. 1B, flexible inner layer 120 may be visible underneath the bottom portion of exterior hard layer 110 as an interface between first fitted cavity 150 and second fitted cavity 160. In some embodiments, case 100 may also include an aperture 125 sized and positioned to accommodate and enable use of a feature of an inserted personal electronic device, such as a camera lens or a light source.

Optionally, exterior hard layer 110 may include one or more cut-away portions 145 that contribute to the overall flexibility of case 100. In one embodiment, a cut away portion 145 may be present at the four corners of case 100. On some occasions, flexible inner layer 120 may fill in a portion of cut away portion 145. This may enable exterior hard layer 110 to sufficiently flex or deform to accept an inserted personal electronic device.

Figure 1C:
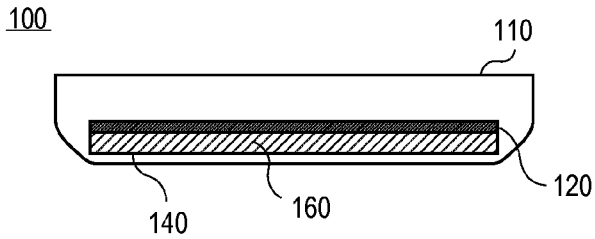
FIG. 1C is a side view of an exemplary case in accordance with embodiments of the present invention.

FIG. 1C is a side view of case 100 that depicts opening 140 into which a card may be inserted into second fitted cavity 160. As can be seen in FIG. 1C, a bottom surface of flexible inner layer 120 acts as a top surface of second fitted cavity 160. On some occasions, case 100 may be customized to accommodate a particular type of personal electronic device. On these occasions, case 100 may include an aperture or other feature 135 sized and positioned to accommodate a feature of an inserted personal electronic device.

Figure 1D:
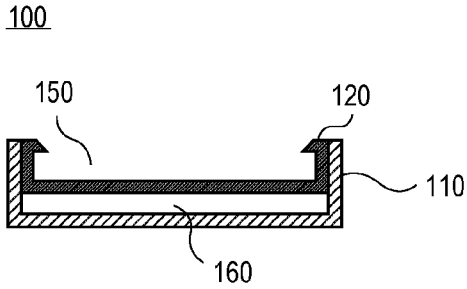
FIGS. 1D and 1E are cross-sectional views of an exemplary case in accordance with embodiments of the present invention.

FIG. 1D is a cross-sectional view of case 100 including exterior hard layer 110 into which flexible inner layer 120 is positioned so as to form first cavity 150 and a top surface of second fitted cavity 160. The bottom surface of flexible inner layer 120 partially or wholly separates first fitted cavity 150 from second fitted cavity 160 and may thereby isolate a personal electronic device inserted into first fitted cavity 150 from a card inserted into second fitted cavity 160 second fitted cavity 160. This isolation may serve to protect the inserted personal electronic device from scratches and other forms of damage that may result from the insertion or storage of cards in second fitted cavity 160. Optionally, flexible inner layer 120 may include an overhang by which an inserted personal electronic device is retained in case 100.

Figure 1E:
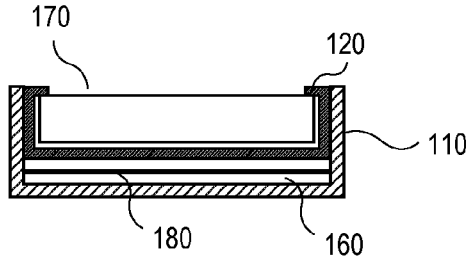

FIG. 1E is a cross-sectional view of case 100 including exterior hard layer 110 into which a personal electronic device 170 is inserted into first cavity 150 and a card 180 is inserted into second fitted cavity 160. Although only one card 180 is inserted into second fitted cavity 160, it should be understood that second fitted cavity 160 might accommodate any number of inserted cards.

Figure 2A:
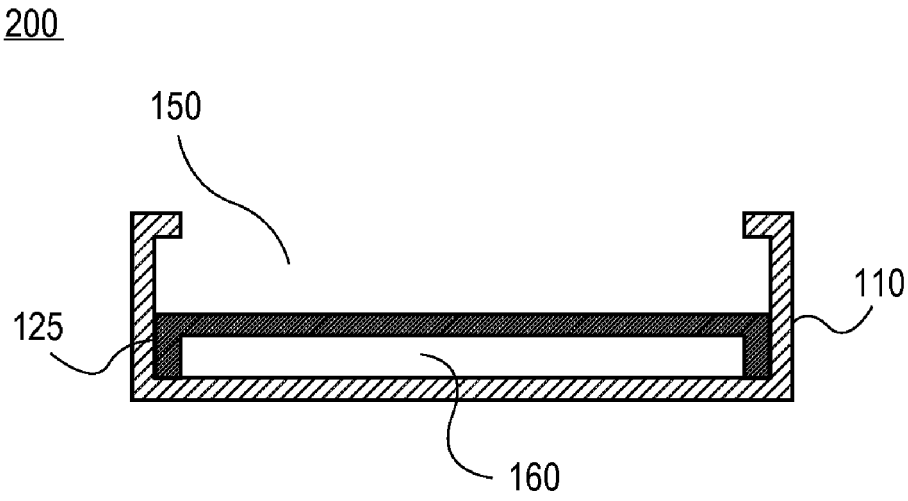
FIGS. 2A and 2B are cross-sectional views of an exemplary case in accordance with embodiments of the present invention.

FIG. 2A is a cross-section view of a case 200 for enclosing a personal electronic device and a card including exterior hard layer 110, a flexible inner layer insert 125, first fitted cavity 150, and second fitted cavity 160. Exterior hard layer 110 of case 200 is similar is shape and configuration to the exterior hard layer of case 100 with the exception that it may include one or more features for retaining an inserted personal electronic device, such as an overhanging portion. Flexible inner layer insert 125 is inserted into exterior hard layer 110 so as to form the bottom portion of first fitted cavity 150 and the top and side portions of second fitted cavity 160.

Figure 2B:
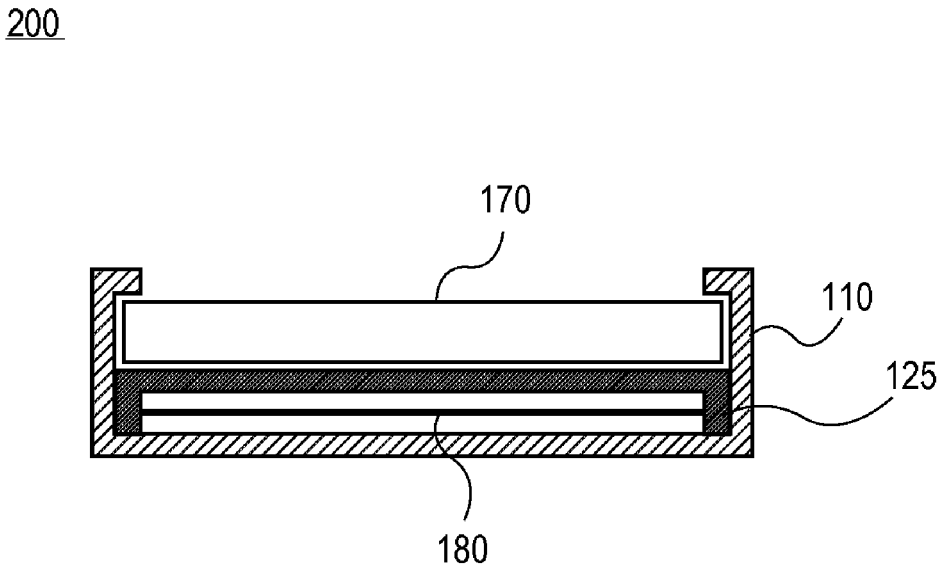
Figure 2C:
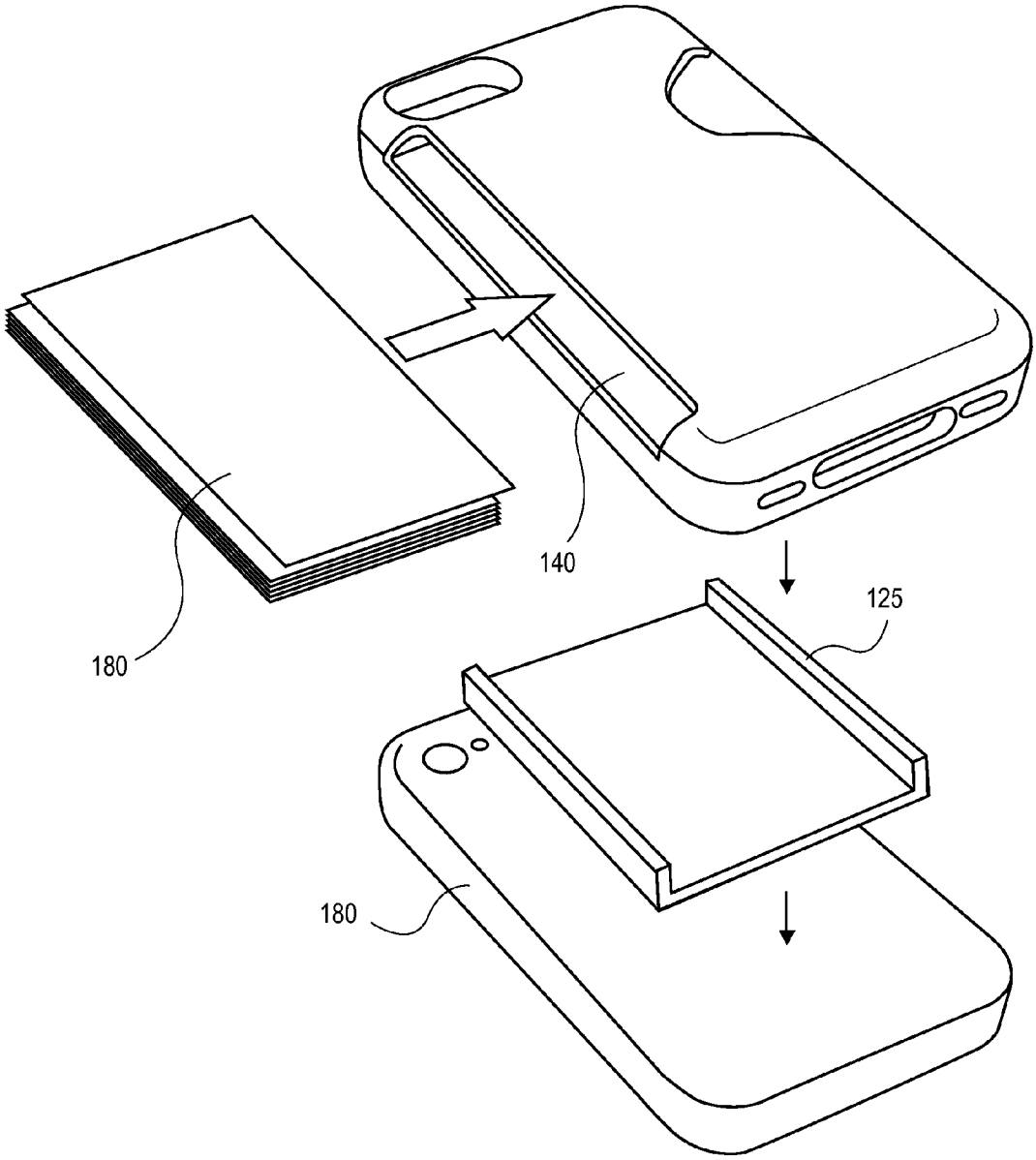
FIG. 2C is an exploded view of an exemplary case in accordance with embodiments of the present invention.

FIG. 2B is a cross-section view of case 200 into which personal electronic device 170 is inserted into first fitted cavity 150 and card 180 is inserted into second fitted cavity 160.

FIG. 2A is an exploded view of case 200 assembly in which card 180 are inserted into exterior hard layer 110 and flexible inner layer insert 125 is inserted into exterior hard layer 110. Personal electronic device 180 is then inserted into the assembly of card 180, exterior hard layer 110, and flexible inner layer insert 125.

Thus, a case for enclosing a personal electronic device and a card has been herein described.

What is claimed is:

1. A one-piece case for enclosing a personal electronic device and one or more cards comprising a flexible inner layer and an exterior hard layer that is permanently affixed to the flexible inner layer, the one-piece case being sufficiently flexible to deform and thereby accept insertion of the personal electronic device and sufficiently rigid to reform around and securely retain the inserted personal electronic device, wherein:

the flexible inner layer includes a bottom surface and side surfaces joined to the bottom surface and extending upward therefrom, thereby forming a first fitted cavity and a top surface of an adjacent second fitted cavity, wherein the first fitted cavity is configured to accept and retain the inserted personal electronic device such that the bottom surface of the flexible inner layer covers a bottom surface of the inserted personal electronic device and the side surfaces cover at least a portion of side surfaces of the inserted personal electronic device; and the exterior hard layer includes a bottom surface and side surfaces joined to the bottom surface and extending upward therefrom, wherein the bottom and a first portion of the side surfaces of the exterior hard layer form the second fitted cavity and a second portion of the side surfaces of the exterior hard layer substantially cover the side portions the flexible inner layer, wherein the second fitted cavity is configured to accept and retain at least one card and at least one of the first portion of the side surfaces includes an opening via which the card is inserted in the one-piece case.

2. The one-piece case of claim 1, wherein the second cavity is configured to accept and retain is at least one of a credit card, a payment card, an identification card, a business card, a coupon, a receipt, a merchandise credit card, and a gift card.

3. The one-piece case of claim 1, wherein the flexible inner layer is manufactured from a material with a coefficient of static friction is sufficient to hold the inserted card in place within the second fitted cavity.

4. The one-piece case of claim 1, wherein bottom surface of the flexible inner layer includes a retaining feature that extends into the second fitted cavity so as to exert pressure on the inserted card and thereby retain the inserted card in the second fitted cavity.

5. A case for enclosing a personal electronic device and one or more cards inserted therein comprising an exterior hard layer and a flexible inner layer insert that is attached to the exterior hard layer, the case being sufficiently flexible to deform and thereby accept insertion of the personal electronic device and sufficiently rigid to reform around and securely retain the inserted personal electronic device and including a first fitted cavity configured to accept and retain the inserted personal electronic device and a second fitted cavity configured to accept and retain the one or more inserted cards, wherein:

the exterior hard layer includes a bottom surface and side surfaces joined to the bottom surface and extending upward therefrom, thereby forming side surfaces of the first fitted cavity and a bottom and side surfaces of the second fitted cavity; and the flexible inner layer insert includes a top surface and two side surfaces joined to the top surface and extending downward therefrom, the flexible inner layer insert being attached to the exterior hard layer so that the two side surfaces of the flexible inner layer insert form the side surfaces of the second fitted cavity and the top surface of the flexible inner layer insert forms the top surface of the second fitted cavity and a bottom surface of the first fitted cavity.

6. The case of claim 5, wherein the wherein the second cavity is configured to accept and retain at least one of a credit card, a payment card, an identification card, a business card, a coupon, a receipt, a merchandise credit card, and a gift card.

7. The case of claim 5, wherein the flexible inner layer insert is manufactured from a material with a coefficient of static friction sufficient to hold the inserted card in place within the second fitted cavity.

8. The case of claim 5, wherein bottom surface of the flexible inner layer insert includes a retaining feature that extends into the second fitted cavity so as to exert pressure on the inserted card and thereby retain the inserted card in the second fitted cavity.

* * * * *